US010048012B2

(12) United States Patent
Panumma et al.

(10) Patent No.: US 10,048,012 B2
(45) Date of Patent: Aug. 14, 2018

(54) TUBE REGISTER FOR INDIRECT HEAT EXCHANGE

(75) Inventors: Rungpunth Panumma, Amphur Muang Chonburi (TH); Jiradet Kunno, Chonburi (TH); Siegfried Broda, Chonburi (TH); Ralf Broda, Banglanung Chonburi (TH); Wiratch Leksawangwong, Chonburi (TH)

(73) Assignee: Babcock Borsig Service GmbH, Oberhausen (DE)

( * ) Notice: Subject to any disclaimer, the term of this patent is extended or adjusted under 35 U.S.C. 154(b) by 1054 days.

(21) Appl. No.: 13/382,431

(22) PCT Filed: Jun. 17, 2010

(86) PCT No.: PCT/EP2010/058564

§ 371 (c)(1),
(2), (4) Date: Apr. 18, 2012

(87) PCT Pub. No.: WO2011/003717

PCT Pub. Date: Jan. 13, 2011

(65) Prior Publication Data

US 2012/0193074 A1 Aug. 2, 2012

(30) Foreign Application Priority Data

Jul. 6, 2009 (DE) ..... 10 2009 031 969

(51) Int. Cl.

| | |
|---|---|
| ***F28F 9/013*** | (2006.01) |
| ***F28D 7/16*** | (2006.01) |
| ***F28D 7/00*** | (2006.01) |
| ***F28D 7/02*** | (2006.01) |
| ***F28D 7/06*** | (2006.01) |
| ***F28F 13/08*** | (2006.01) |
| ***F28G 9/00*** | (2006.01) |
| *F28D 21/00* | (2006.01) |

(52) U.S. Cl.
CPC ..... *F28D 7/16* (2013.01); *F28D 7/0066* (2013.01); *F28D 7/024* (2013.01); *F28D 7/06* (2013.01);
(Continued)

(58) Field of Classification Search
CPC .... F28D 7/0066; F28D 21/0003; F28D 7/024; F28D 7/16; F28F 13/08; F28F 9/013; F28F 2210/00; F28G 9/00
(Continued)

(56) References Cited

U.S. PATENT DOCUMENTS 3,415,316 A 12/1968 Burne et al.
3,545,534 A * 12/1970 Coles ..... 165/67
(Continued)

FOREIGN PATENT DOCUMENTS

DE 3841180 C1 4/1990
DE 19647189 C1 8/1998
(Continued)

*Primary Examiner* — Justin Jonaitis
*Assistant Examiner* — Eric Ruppert
(74) *Attorney, Agent, or Firm* — The Webb Law Firm

(57) ABSTRACT

A register for the indirect heat exchange between a utility fluid containing interfering components and a heat transfer fluid has at least one tube row with at least one flow channel with a small channel width and at least one flow channel with a large channel width. Additionally, in at least one tube row there is provided at least one flow channel with a narrow section defined by a small channel width as well as a wide section defined by a large channel width. The large channel width produces a large flow velocity of the utility fluid and the small channel width produces a small flow velocity of the utility fluid.

44 Claims, 8 Drawing Sheets

(52) U.S. Cl.
CPC ..... *F28F 9/013* (2013.01); *F28F 13/08* (2013.01); *F28G 9/00* (2013.01); *F28D 21/0003* (2013.01); *F28F 2210/00* (2013.01); *F28F 2210/08* (2013.01); *F28F 2240/00* (2013.01)

(58) Field of Classification Search
USPC ..... 165/69, 104.11, 172, 67, 157
See application file for complete search history.

(56) References Cited

U.S. PATENT DOCUMENTS

| | | | | |
|---|---|---|---|---|
| 4,753,197 | A * | 6/1988 | Mullinax | F22B 37/203 122/510 |
| 4,827,953 | A * | 5/1989 | Lee | 134/172 |
| 5,092,280 | A * | 3/1992 | Franklin et al. | 122/379 |
| 5,791,404 | A | 8/1998 | Bailey et al. | |
| 6,244,330 | B1 * | 6/2001 | Eisinger et al. | 165/69 |
| 2003/0089491 | A1 | 5/2003 | Mitsumoto et al. | |
| 2008/0216995 | A1 | 9/2008 | Ikonen et al. | |
| 2009/0020273 | A1 * | 1/2009 | Schneider et al. | 165/162 |

FOREIGN PATENT DOCUMENTS

| | | | |
|---|---|---|---|
| EP | 1923652 | A2 | 5/2008 |
| EP | 1967807 | A1 | 9/2008 |
| GB | 813152 | * | 5/1959 |
| JP | 5949495 | A | 3/1984 |
| JP | 11193993 | A | 7/1999 |
| JP | 2001116481 | A | 4/2001 |
| JP | 2005326034 | A | 11/2005 |

* cited by examiner

TUBE REGISTER FOR INDIRECT HEAT EXCHANGE

BACKGROUND OF THE INVENTION

Field of the invention

The present invention relates to a register for indirect heat exchange between a utility fluid, in particular a flue gas, containing an interfering component, and a heat transfer fluid in a heat exchanger, with a plurality of tubes for the passage of the heat transfer fluid, wherein the tubes are arranged in a plurality of tube layers as well as a plurality of tube rows, wherein the tube layers and the tube rows run transverse to one another and wherein the tube layers define a plurality of flow channels for the flow through of the utility fluid. In addition the invention relates to a heat exchanger with at least one register, and also a use of the register.

Description of Related Art

Registers of a heat exchanger comprise a plurality of tubes and are also termed tube bundles. The tubes form tube layers arranged parallel to one another. In this way flow channels for the flow through of the utility fluid are formed between the tube layers. Transverse to the tube layers the tubes form so-called tube rows, which are likewise arranged parallel to one another. In a register of a heat exchanger the distances between the tube rows are constant just like the distances between the tube layers. A register is therefore constructed symmetrically. The structure of a register, i.e. the exact arrangement of the tubes with respect to one another, is described by the so-called pitch.

If the tube rows and the tube layers are aligned perpendicular to one another, this is then described as a square pitch if the tube rows and the tube layers are spaced equally far from one another. If this is not the case, then it is described as a rectangular pitch. For an accurate definition of the arrangement of the tubes in addition to the nature of the pitch the distance of the tube mid-points between two tube rows and two tube layers is also specified. With a square pitch it is therefore sufficient to specify one distance.

If the tube rows and the tube layers are not aligned perpendicular to one another, then this is described as a triangular pitch. The tube mid-points of three adjacent tubes then lie at the corners of a triangle, which may be, but does not have to be, an equilateral triangle. If the lengths of the sides of such a triangle are known, then the arrangement of the tubes in the register is just as uniquely fixed as when in the case of square or rectangular pitches the lengths of the sides of a square or rectangle formed by the tube mid-points of adjacent tubes are specified. Within a register the distances relating to the respective pitch do not alter. Registers with a square pitch and a triangular pitch are diagrammatically illustrated in FIGS. 1*a* and 1*b* for the sake of clarity.

Heat exchangers comprising such registers are known in various embodiments from practice and are referred to in particular as tube bundle heat exchangers. A heat exchanger can in this case comprise one or more registers. The heat exchangers are used for heat exchange between different fluids, which may be liquid or also gaseous. The fluid flowing through the register is hereinafter referred to as utility fluid, and the fluid flowing through the tubes of the register is referred to as heat transfer fluid.

If several heat exchangers are used in a process, then the utility fluid of a heat exchanger can if necessary be used as heat transfer fluid of another heat exchanger. In this case the utility fluid after leaving the one heat exchanger and before entering the other heat exchanger as heat transfer fluid is normally treated in a further process stage, such as a condensation or a separation of interfering components.

Heat exchangers are also known that operate in so-called cross-current. In this case the heat exchanger or at least a register is subdivided into two regions separated from one another, so that in the two regions different utility fluids flow around the tubes of the register. The flow directions of the utility fluids can in this case be opposite. The heat transfer fluid within the tubes of the register then in this case transports heat from one region of the register to the other region of the register, so that one utility fluid transfers heat to the other utility fluid. The utility fluids may be one and the same fluid stream at two different points in time during a technical process, for example for the processing, conditioning and/or cleaning of the fluid stream.

The heat exchangers and registers are used for example to cool or heat up a utility fluid in the form of a flue gas that is produced during combustion of a fuel. For this purpose the heat exchangers are for example integrated in a waste-gas purification plant. Heat exchangers designed to cool flue gases are for example connected in the form of a gas cooler upstream of a flue gas scrubber, whereas heat exchangers provided to heat flue gases can be connected downstream of a flue gas scrubber, in order to dry the flue gas. In this connection the temperature of the flue gas is raised to a higher level in order to prevent individual components condensing out in plant units connected downstream. Gas coolers as well as gas dryers can be provided in waste-gas purification plants.

Flue gases can, also like other media, contain a not inconsiderable amount of interfering components. These interfering components are predominantly particles, for example in the form of dusts. Interfering components may however also be liquids, such as for example condensate or wash liquid entrained on discharge from an upstream washer. The liquid is in this connection divided into a plurality of individual droplets. The condensate, especially in the treatment of flue gases, may be an acid or aqueous acidic solution. In addition the condensate can be introduced like other liquids and/or solids into the heat exchanger. The condensate can however also be formed first in the heat exchanger or in at least one register of the heat exchanger by a lowering of the temperature. In general a distinction is made in this case between the aggregate state of the interfering component and that of the utility fluid.

The interfering components in a utility fluid, such as for example a flue gas, may be homogeneous, for example of the same substance, or heterogeneous, composed of different substances.

The interfering components can coalesce in the heat exchanger, in particular in at least one of the registers of the heat exchanger, and collect there. Registers that are operated with utility fluids containing a relatively large concentration of interfering components should therefore be cleaned at regular intervals so that no blocking of the register occurs between individual tubes. Furthermore it can however also be undesirable if the interfering components are simply extracted with the utility fluid.

For the cleaning, a relatively large amount of rinse medium is often added to the utility fluid before entry to the register during operation, the rinse medium then being entrained by the flow of the utility fluid and carried through the register. This generally occurs at more or less regular, predetermined time intervals. The rinse medium can if necessary also be introduced uniformly distributed within the tube bundle of the heat exchanger. The rinse medium, which is generally water, should however in any case come into contact with the interfering components collecting in the register and remove these together with the rinse medium, in particular in the flow direction of the utility fluid, from the register.

So that the register has as small a tendency as possible for interfering components to collect and can at the same time be thoroughly cleaned, the register is constructed so that the utility fluid has a high flow velocity between the tube layers, which are aligned in a regular manner parallel to the outflow direction of the utility fluid. This is achieved in particular if the registers are constructed of tubes with relatively large diameters, which for this purpose are arranged at large distances from one another. In the end broad flow channels are thereby formed between the tube layers, which offer a low flow resistance to the utility fluid and through which utility fluid can thus rapidly flow.

Nevertheless it has been found in practice that the interfering components can collect to a large extent in the register, which can lead to the partial blockage or clogging of the register, for example in flow shadows between the tubes of a tube layer. This then means for example that continuously operating plants have to be shut down prematurely in order to service the register or clean it manually. This often leads in the case of hardening interfering components to damage to the tubes and/or to their corrosion protection due to the difficult and in some cases mechanical cleaning. This in the end leads to undesirable tube failures.

SUMMARY OF THE INVENTION

The object of the present invention is therefore to design and develop a register and a heat exchanger of the type mentioned in the introduction, so that when operating with utility fluids containing large amounts of interfering components, such as for example flue gases, the tendency to contamination and blockage is reduced and in this way longer service lives can be achieved in continuous operation.

The aforementioned object is achieved according to the invention with a register having at least one tube row provided with at least one flow channel with a small channel width and also at least one flow channel with a large channel width, and/or at least one tube row provided with at least one flow channel with a narrow section defined by a small channel width and also a wide section defined by a large channel width, wherein the large channel width is designed to produce a high flow velocity of the utility fluid and the small channel width is designed to produce a low flow velocity of the utility fluid.

The present invention has recognised that, contrary to the previous teaching regarding the design of heat exchange registers, the symmetrical arrangement of the tubes in the registers is disadvantageous as regards an undesirable accumulation of interfering components in continuous operation.

On the basis of this knowledge the invention has accordingly dispensed with an extremely symmetrical structure of the register and has created a register that is to some extent intentionally constructed asymmetrically. This intentional asymmetry is created by providing in the register flow channels with considerably different channel widths. A considerably different channel width means in this connection that the channel widths noticeably differ from one another, and that the flow resistances in the flow channels significantly differ from one another. The difference between the channel widths is in this connection dependent on the utility fluid and the process conditions and accordingly cannot be quantified exactly. Alternatively however it may also be envisaged that at least one flow channel has different sections with different channel widths, the differences being significant in the sense described hereinbefore. If necessary a combination of the previously described alternatives is also possible.

Large channel widths mean that the flow resistance counteracting the utility fluid decreases and at the same time the flow velocity of the utility fluid increases. In this comparison it is assumed of course that there is a constant pressure loss of the utility fluid stream when flowing through the register. With small channel widths the flow resistance increases however, so that in these regions of the register a lower flow velocity prevails. According to the invention regions with different flow velocities in the register are therefore produced completely intentionally.

A small channel width is in this connection so small that the utility fluid flow is retarded to such an extent that this leads to a noticeable settling of interfering components entrained by the utility fluid. In the regions with a large channel width the flow velocity is on the other hand so high that the retardation of the utility fluid flow in the regions of small channel width can be compensated. This preferably means that, for a constant pressure loss, the same volume flow of utility fluid flows through the register as in a symmetrical arrangement of the tubes in the register. Depending on the available pressure loss, there is not in this case an exact observance of the aforementioned connection. In addition it is assumed with this pressure loss observation that the register is not contaminated. Otherwise, with a conventional register, on account of the higher depositions of interfering components the utility fluid flow can for the same pressure loss be significantly less than in the case of the previously described register.

The large channel width can, depending on the specific application, preferably be more than 1.10, more than 1.25, more than 1.5 more than 2.0, more than 2.5 or more than 3.0 times as large as the small channel width. In principle therefore a noticeable difference between the large and small channel widths is preferred. At the same time or alternatively it can however be a hindrance as regards the flow distribution within the register if the differences between the large channel width and the small channel width are too significant, so that in certain circumstances non-active dead zones can be formed in which no flow occurs. With differences that are too large as regards the channel widths, then alternatively or in addition the heat-exchange surface as the sum of the jacket surfaces of the tubes of the register can be greatly reduced, which can have an unfavourable effect on the heat to be exchanged per volume of the register. The large channel width should therefore if necessary not be more than 5, not more than 4, not more than 3 or not more than 2 times as wide as the small channel width.

Differently dimensioned large channel widths and/or differently dimensioned small channel widths may also be provided within a register. In this way a high degree of asymmetry and thus a large number of different flow states are created within the at least one register of a heat exchanger.

The above details regarding the dimensions of large and small channel widths also applies to flow channels of individual tube rows, in which there is a constant channel width between two adjacent tubes, as well as to those tube rows in which between two adjacent rows there is over some sections a large channel width and over other sections a small channel width.

If necessary regions can be provided in the register in which the flow of the utility fluid almost comes to a stop. This is not necessarily the case however. The flow velocity in these quiet zones should however be reduced to such an extent that the interfering components and/or rinse media added for cleaning purposes can noticeably settle under the action of gravity. Of course, the flow should also not completely come to a stop since then also no flow components would flow any longer into the quiet zones and there sink to the bottom. Also, the flow velocity should not be reduced to such an extent that the flow channels become too wide in the regions with a large channel width, since this can have a negative effect on the heat exchanger. The flow velocity in the regions with a large channel width should also not have to be increased so significantly in order to be able to still transport the necessary volume stream through the register, that this is offset by a markedly increased pressure loss in this case.

In order that the interfering components in the quiet zones in the register, i.e. in the region of small channel widths, can sink under the action of gravity, interfering components are removed from the utility fluid. The interfering components can in this connection sink completely to the bottom, and the deposited interfering components can preferably be removed in any suitable way and means in order to prevent an accumulation. In particular a partial stream of the interfering components flowing into the register will sink under the action of gravity and be deposited on the floor of the register, while the other part is removed together with the utility fluid from the register in the flow direction of the utility fluid.

If the interfering components are particles or condensate, it may be sufficient if these interfering components sink to some extent in quiet zones and re-enter, at a lower level, zones of higher flow velocity, so as then to leave the register together with the utility fluid stream. A blockage of the register can thereby if necessary already be avoided. Corresponding heat exchangers are preferably designed as gas coolers. If the heat exchanger is designed as a gas dryer, in which the utility fluid is heated, and if the interfering components are droplets introduced with the utility fluid, which for example are entrained from an upstream gas scrubber or dry separator, it is preferred to draw the interfering components substantially completely to the bottom and in this way remove them smoothly from the utility fluid stream after the latter enters the register. This is energetically preferred, since the droplets deposited on the bottom do not have to be evaporated in the register in order to achieve the necessary dryness of the utility fluid when leaving the register. The necessary dryness of the utility fluid is then achieved if its temperature lies sufficiently above the dew point and/or the utility fluid in any case no longer contains any droplets.

With tube bundle heat exchangers of the prior art the proportion of the interfering components that is not extracted again with the utility gas flow accumulates in at least one register of the heat exchanger, for example in the form of adhering particles or agglomerations, which necessitates a premature shutdown and cleaning of the register.

On account of the fact that with the register according to the invention high flow velocities of the utility fluid can be achieved in the wide sections with a larger channel width, this preferably leads to turbulences within the heat exchanger, which in the end can in turn cause interfering components from the regions of higher flow velocity to reach regions of slower flow velocity and there sink to the bottom. Interfering components can also pass from the rapidly flowing utility fluid from quiet zone to quiet zone and thereby sink to the bottom in stages or only partially sink, and can for example be removed at a deeper point from the register via channels of large channel width.

Interfering components are understood to mean the plurality of particles and/or droplets entrained by the utility fluid. The interfering components may therefore have as desired a homogeneous or a non-homogeneous composition, wherein the interfering components can also consist of different materials and if necessary have different states of aggregation.

The heat transfer fluid flowing through the tubes may if necessary be a so-called heat transfer medium, specially provided for heat transport. In particular water and oils are suitable for this purpose. Alternatively the heat transfer fluid may however also be a process medium that preferably, just like the utility fluid, is likewise present in any case and preferably has to be heated or cooled in any case. The heat transfer fluid can for example also be a flue gas. Heat transfer fluid and utility fluid may be gaseous and/or liquid as desired. Preferably the utility fluid is a flue gas, furthermore preferably a flue gas that has to be cooled or heated.

The register serves for indirect heat exchange, since the heat transfer fluid and the utility fluid do not come into direct contact with one another, but the heat is simply transferred through the tube walls.

The register comprises a plurality of tube layers and tube rows, wherein the tubes of one tube row are part of different tube layers, and vice versa. In this connection the tube layers extend substantially in the flow direction of the utility fluid, while the tube rows are aligned inclined, optionally transverse, to the flow direction of the utility fluid.

The tubes of at least one tube layer can in this connection be arranged in the flow direction of the utility fluid in each case flush behind one another or however also displaced with respect to one another, while the tubes of at least one tube row are arranged transverse to the flow direction of the utility fluid in each case flush behind one another or however also displaced with respect to one another.

The width of a flow channel is in this connection always determined in a tube row, and specifically is the distance between two adjacent tubes bordering the flow channel. In this way the channel with of at least one flow channel of a register can vary from tube row to tube row, but can also remain constant. In the case where the flow channel in at least one tube row contains sections of different channel widths, i.e. narrow and wide sections, the narrow and wide sections can be arranged uniformly behind one another from tube row to tube row in the flow direction of the utility fluid. It may however also be envisaged that a narrow section in the flow direction follows a wider section in the following tube row, or that the channel width of the narrow and of the wide sections varies in successive tube rows as well as also in one and the same tube row.

It is understood that when at least one tube row, tube layer or flow channel is discussed herein, this can also mean an arbitrary plurality of tube rows, tube layers and/or flow channels. For example, this can be an overwhelming majority whose proportion exceeds 50%. However, all or substantially all tube rows, tube layers and/or flow channels may also be intended.

In a first design of the register a simple fabrication and a simple layout of the register may be provided, in which at least individual flow channels of the register have a constant channel width in tube rows of the register following one another in the flow direction of the utility fluid. The channel width of a uniform flow channel therefore does not alter in the transition from one tube row to the next tube row in the flow direction. In other words, the register constructed in this way has flow channels that are formed identically in successive tube rows. In this connection these flow channels can have a constant but also a varying channel width in the direction of the respective tubes. Preferably, since it is easy to produce, at least one flow channel has a constant channel width along all tube rows of the register. The channel width of the flow channel therefore does not alter along the flow direction of the utility liquid. At the same time however the corresponding flow channel does not necessarily have to have a constant channel width in the direction of the tubes, but can possibly have alternately narrow as well as wide sections with correspondingly small and large channel widths.

To simplify the fixing of the tubes of the register, alternatively or addition it may be envisaged that in at least one tube row each tube is fixed to a retaining element that is formed in the shape of a rod and extends substantially along the tube layers. The influence on the flow can thus be minimised. In addition the rod-shaped retaining elements of a tube interfere only minimally in the settling of the interfering components.

If necessary the at least one retaining element may also be in the form of a grid, or may be bent particularly around tubes adjacent to the retaining element. The retaining elements interfere with the settling of the interfering components as little as possible and if necessary in addition allow a certain mobility of the tubes, especially if these are flexibly arranged. In general metals, ceramics or plastics are suitable materials for the production of the retaining element, and the metals may have a corrosion protection that is formed if necessary by a plastics casing. Fluorinated plastics in particular are suitable as plastics material for the retaining element or the casing.

A structurally simple and also effective possibility exists if in at least one tube row in each case a retaining element is provided in every second flow channel. The tubes adjacent to each retaining element are then fixed to the latter, more specifically preferably at the side.

Alternatively it may however also be envisaged that exactly one tube layer is fixed on at least one retaining element of the register, while exactly two adjacent tube layers are fixed on at least one other retaining element. This is convenient in particular when using tubes of different diameters in at least one tube row. Then for example alternately one tube layer with tubes of a large diameter can be secured to its own retaining element, while adjacent thereto two tube layers with tubes of smaller diameter are fixed to a common retaining element arranged between the tube layers.

In this case it is particularly advantageous for the free settling of the interfering components if the retaining elements run substantially laterally to the tube layers held by the retaining element.

In addition to the fixing the retaining elements can also serve for the positioning of the tubes of at least one tube row or the whole register. For this, it may be envisaged that the retaining elements between the tubes of at least one tube row located on the retaining elements have spacers for spacing the tubes located on the said retaining elements. Alternatively or in addition it may however also be envisaged that the retaining elements are formed directly as spacers. They then have between the tubes to be spaced apart in each case a width that corresponds to the desired interspacing of the tubes, without the need of a further structural part for this purpose.

So that the retaining elements do not interfere too strongly in the flow of the utility fluid through the register, it is advantageous if the retaining elements are arranged either in flow channels with a small channel width and/or in narrow sections of the respective flow channel of at least one tube row. In addition the tubes in these flow channels and/or sections in any case have a small distance to the mutually adjacent tubes, so that a fixing of the tubes can be achieved with a saving in material. In this case the retaining elements interfere only slightly in the settling of interfering components in quiet zones, since the retaining elements are arranged laterally on the tubes.

In this connection it is possible for the retaining elements to be provided along the whole respective tube layers in each case in flow channels of small channel width and/or narrow sections of the flow channels. In this way the described advantages are achieved in all successive tube rows of the register. Alternatively or in addition it is preferred for structural reasons if the retaining elements are always provided in every second flow channel. This is sufficient in order to fix all tubes of a tube row and thus of the register as a whole.

So that the at least one retaining element influences the settling of interfering components even less, the retaining element can also be arranged in the flow channels with a large channel width and/or in wide sections. Interfering components that settle on a retaining element are then more easily removed and do not accumulate so markedly during operation. Preferably the retaining element is then aligned along a flow channel with a wide channel width and extends in this flow channel along a tube layer bordering the flow channel. In this case retaining sections of the retaining element can thereby then be provided that join the tubes of this tube layer to the retaining element.

If despite the formation of quiet zones and zones of increased flow velocity of the utility fluid through the arrangement of the tubes of the register between one another it is still necessary to clean the register in operation, a rinse line for feeding rinse medium can be provided in at least one tube row in at least one flow channel with a small channel width or in a narrow section. In this connection the rinse line extends substantially in the direction of the tube layers and/or in the direction of the flow channels, which is preferably in the same direction.

It is particularly convenient for the cleaning of the register if a rinse line is provided in at least one tube row in each flow channel with a small channel width. In addition or alternatively, in flow channels with a varying channel width on a common plane a rinse line can in each case be provided in the narrow sections of the flow channels. Wide sections of flow channels of the register can if necessary manage without a rinse line.

So that all regions of the register, in particular the quiet zones of the register, can be reached equally by the rinse liquid, it is advantageous to provide in at least one tube row a rinse line in every second flow channel. This applies in particular if the in each case at least second flow channel has a small channel width and varying channel width.

In addition to supplying rinse liquid the rinse lines can be designed as spacers for spacing the rinse line of adjacent tubes of the at least one tube row. This is achieved in a structurally simple manner if the rinse lines have a diameter that corresponds to the preferred interspacing of the adjacent tubes in the region of the respective rinse line.

The rinse lines can in addition be arranged in each case in the flow channel of small channel width and/or in the narrow section of the flow channel, since in this way the rinse liquid can be fed specifically to the quiet zones, the flow in the flow channels of large channel widths is not adversely affected, and the tubes in the said flow channels and/or in the said sections can in any case lie close to one another.

In order to minimise the structural effort involved in the fabrication of the register, at least one retaining element can be designed at the same time as a rinse line, or vice versa. In this connection it is convenient if the at least one retaining element has a substantially closed profile, through which the rinse medium can flow, the rinse medium being able to leave the corresponding profile through a series of openings.

Alternatively or in addition it may be envisaged that at least one tube layer is at least in sections aligned slanting and/or bent in relation to the inflow direction of the utility fluid through the register. As a result the free flow channel for the utility fluid is inclined relative to the inflow direction of the register. The utility fluid as such is thereby preferably deflected, and specifically in the direction of the free flow channel. The interfering components, which preferably have a higher density, are however subjected greater inertial influence and are deflected less strongly or hardly at all. In this connection the tubes of a tube layer are preferably arranged displaced with respect to one another so that the interfering components if necessary impact in the further course of the flow against a tube of a further tube row arranged behind in the flow direction, or preferably against a tube arranged further behind in the flow direction, of a tube layer defining the flow channel. The flow velocity of the utility fluid is reduced directly at the tubes, so that the interfering components impacting against a tube can more readily sink to the bottom under the force of gravity.

Preferably the tubes arranged behind one another in the flow direction are in each case displaced only by a part of the channel width. The tubes are then not set facing one another at gaps, which is more unfavourable from the point of view of flow, but always stand further in the flow channel defined by the front tube row. The flow channel can then be widened to the same or a similar extent on the other side, so that the flow channel overall has substantially a constant channel width along at least one tube layer. The flow channel is however inclined somewhat to the inflow direction of the register. This arrangement has the effect that interfering components entrained by the utility fluid, in particular in the form of droplets, flow through the register without any problem, but impact with a fairly high degree of probability against one of the tubes of the register, which projects into the flow channel in the inflow direction.

So that corresponding registers can be produced simply and in addition fluid can flow through them relatively uniformly, it may be envisaged that at least two tube layers form between them a flow channel with an opening on the inlet side and an opening on the outlet side for the utility fluid, in such a way that the opening on the inlet side in the inflow direction of the utility fluid in relation to the register does not overlap the opening on the outlet side. An interfering component, for example in the form of a droplet, then cannot, or in any case scarcely, be carried through this rectilinearly in the inflow direction of the register. Instead there is a very high probability that the droplets will strike against tubes of one of the tube layers and will accordingly be deposited. Thus, a removal of for example entrained liquid from the utility fluid is possible. Preferably the opening on the inlet side is the channel width of the flow channel formed in the flow direction of the utility fluid in the foremost tube row, while the opening on the outlet side is similarly the channel width of the flow channel of the rearmost tube row. Alternatively, the terms inlet side and outlet side instead of referring to the register as such can also refer to a partial region of the register, so that further tubes or tube rows can be allocated on the inlet side and/or outlet side.

It may be envisaged that flow channels with constant channel widths are arranged in at least one tube row. This can be accomplished easily and cost-effectively, especially with rectilinear tubes. Nevertheless if necessary a asymmetry can be created in a tube row by providing there flow channels that have varying channel widths along the longitudinal length of the tubes, i.e. preferably wide sections and narrow sections.

The register in principle becomes even simpler and more cost-effective if at least the flow channels situated in a tube row have in each case a constant channel width. The channel width is in this connection constant in the direction of the longitudinal length of the tubes. Preferably the channel widths in all tube rows of the register are constant. This allows a very simple and thus cost-effective construction of the register, the tubes being formed in particular rectilinearly.

Alternatively or in addition it may be envisaged that in at least one tube row there is arranged at least one flow channel with alternating narrow sections and broad sections. This enables a register to be constructed for example with the desired asymmetry by a combination of flow channels with a constant channel width and flow channels with a varying channel width in one tube row but also however in different tube rows. The flow channels are in this case understandably provided in the longitudinal length of the tubes with a constant or varying channel width.

So that the construction of the register does not have to be too complicated despite the desired asymmetry of the register, in at least one tube row all flow channels have in each case varying channel widths, wherein in each individual flow channel of the tube row narrow sections alternate with wide sections.

A further, possibly additional, way of forming an asymmetry in the register without having to construct and configure the register in a random and therefore complicated manner, could be to arrange next to one another in at least one tube row in a direction perpendicular to the tubes of the tube row narrow sections and wide sections of adjacent flow channels alternating with one another. This means that in the at least one tube row there is provided at least one flow channel that has a wide section on a specific plane perpendicular to the tubes, while the adjacent flow channel on this plane has a narrow section.

At the same time or as an alternative it may be envisaged that individual flow channels of the register in successive tube rows in the flow direction of the utility fluid have alternately a small channel width as well as a large channel width and/or a narrow section as well as a wide section of the flow channels. The channel width of a same flow channel changes therefore at the transition from one tube row to the next tube row in the flow direction. In other words, the register constructed in this way has flow channels that in successive tube rows have a shape that varies, and particularly preferably alternates, in the flow direction of the utility fluid. The shape of the flow channels thus varies and allows an asymmetric structure of the register, which at the same time can therefore easily be produced and calculated for the purposes of the layout.

One possibility of combining regions with a large channel width and a narrow channel width in one register is if at least individual tubes of at least one tube row are over some regions part of a first row layer and over other regions part of a second row layer. The corresponding tubes therefore run in sections in one tube layer and in sections in at least one further tube layer. This is achieved for example if adjacent tubes of a tube row are crossed with one another, wherein one tube is led from one tube layer of the tube row to the adjacent other tube layer of the tube row, while the adjacent tube is led from the adjacent other layer to the one tube layer. A corresponding crossover of the tubes can be implemented singly but also multiply in a tube row in a flow channel.

It is understood of course that the tubes of arbitrary tube layers in a tube row can be crossed with one another or also arbitrary tubes of a tube layer can be crossed with one another. It is also possible for tubes to cross one another that belong on the one hand to different tube rows and on the other hand to different tube layers. For the sake of simplicity it is however envisaged that adjacent tubes of a tube row run in sections in immediately adjacent tube layers of the tube row.

A simpler, more regular but also non-symmetrical structure of the register can be achieved if a flow channel defined by a first tube layer and a second tube layer has in at least one tube row a plurality of narrow sections and/or wide sections. In other words, in at least one flow channel between two tubes crossed over one another in at least one tube row along the longitudinal direction of the tubes there are provided exclusively wide sections, exclusively narrow sections or alternately wide and narrow sections, and preferably alternating sections. Exclusively narrow sections occur when the tubes of the two tube layers of a tube row defining the flow channel always cross one another alternately along the longitudinal direction of the tubes and only narrow flow cross-sections remain free between the crossover points. The wide sections are then preferably provided in adjacent flow channels of the same tube row. For this purpose it is then if necessary sufficient if the adjacent tubes of the tube row run rectilinearly, since the crossed tubes ensure that the thereby formed channel width of the adjacent flow channel varies.

In this way an asymmetry of the register can be produced in a simple way in that at least individual tubes of at least one tube row cross one another, preferably multiply, along the longitudinal length of the tubes.

A relatively regular structure of the register with a large number of wide sections as well as narrow sections is then obtained if substantially all tubes of at least one tube row are crossed, preferably multiply, with in each case neighbouring tubes along the longitudinal length of the respective tubes.

The crossover points of tubes crossed tubes with one another can in this connection lie on the same planes perpendicular to the longitudinal length of the tubes, like the crossover points of the adjacent tubes crossed with one another. Alternatively or in addition, for example in a further tube row, the crossover points of tubes crossed with one another can lie on a first row of planes, while the crossover points of the adjacent tubes of the tube row lie on a second row of planes, which are likewise aligned perpendicular to the longitudinal length of the tubes. In this case planes of the first row of planes and planes of the second row of planes can always be provided alternately in the longitudinal length of the tubes, wherein in a particularly regular, even if not symmetrical, register arrangement the distances between the individual planes are always identical. Preferably, since it is easier to implement, the crossover points of in each case two tubes crossed with one another always lie alternately on the first row of planes and on the second row of planes. Adjacent crossed tubes are therefore always arranged alternately in the longitudinal direction of the tubes and displaced with respect to one another by the interspacing of the planes of different rows.

Not all tubes of a tube row have to be crossed with one another, and it may be simpler for the production of the register if rectilinearly formed tubes are provided adjoining crossed tubes in a common tube row, which then form with the crossed tubes a flow channel in the tube row, which has varying channel widths, so that if necessary narrow sections and wide sections can alternate.

Varying channel widths and thus an intentional asymmetry of the register can be achieved structurally in a particularly simple manner if in at least one tube row and/or in at least one tube layer tubes are provided having noticeably different tube diameters. In this case in the at least one tube row or tube layer tubes with different diameters can be arranged alternately and in such a way with respect to one another that the flow channels with different channel widths are produced therefrom. It may however also be envisaged that each tube of at least one tube row with a larger diameter is arranged adjacent to in each case two tubes of the at least one tube row with a smaller diameter. In other words, in a tube row if necessary two thin tubes are followed by a thick tube, which is then followed in turn by two thin tubes, and so on.

In this connection exclusively tubes with an identical tube diameter may be provided in at least one tube layer. In the end the register can thus be composed simply of tube layers with the same type of tubes.

Irrespective of the arrangement of the tubes of the register, it is preferred if the tubes are made of a plastics material, preferably a fluorinated plastics, in particular perfluoroalkoxy (PFA). In this way a high resistance to corrosive media is achieved. Alternatively or in addition the tubes can be made of metal, preferably of a suitably resistant metal, in particular of a corrosion-resistant metal.

Furthermore it may be desirable if the tubes are designed to be flexible, so that the tubes can easily be arranged in the desired alignment with respect to one another. This is especially the case if individual tubes are to be crossed with one another. The necessary flexibility can be ensured without any problem by the aforementioned plastics material of the tubes.

Under certain conditions the register can however also include flexible as well as rigid tubes. This is convenient for example if the rigid tubes are to contribute to the stability of the register. When using tubes of different diameters it may for example be envisaged that the tubes of larger diameter are rigid, while the tubes of smaller diameter are flexible. Alternatively or in addition it is possible for rectilinear tubes of a register to be rigid and for the bent tubes of the same register to be flexible. It may however also be envisaged that the flexible tubes are made of a plastics material and the rigid tubes of metal.

In order to reduce the fluid sound occurring in the register, the tubes of at least two adjacent tube layers with mutually displaced tubes can be brought very close to one another in a simple manner, if necessary even overlapping. Then, if at all, only very narrow gaps transverse to the flow direction of the utility fluid remain between the corresponding tubes. In the end the tubes jointly form a so-called tube disc, which to a large extent reflects the sound waves. Alternatively or in addition at least one corresponding tube disc can be provided by bringing the tubes of at least one tube layer so close to one another that no, or only very slight, gaps remain between the tubes of this tube layer. In order to achieve this, then in the at least one tube layer either the number of tubes is significantly increased compared to other tube layers or their diameter is significantly increased compared to other tubes of the register. In this connection it may alternatively or additionally be advantageous to cross adjacent tubes of the at least one tube layer with one another in order to obtain in this way a stabilised "wickerwork" of tubes or a tube disc of tubes crossed with one another. This is feasible especially if the tubes of the tube register are flexible, and are made for example of plastics material. Alternatively in the case where the tubes of the register are formed substantially flexible, also the tubes of the at least one tube layer for reflecting the sound can be formed rigid, for example made of metal.

It is particularly preferred to provide corresponding tube layers formed in the manner of a tube disc on or adjacent to both edges of the register. Also, such a tube layer may additionally or alternatively be advantageous for example in the middle of the register. Two to six tube discs might well be preferred in the normal case, in order to achieve a significant sound reduction due to reflection of the fluid sound.

In a first preferred modification of the heat exchanger it is envisaged that in the flow direction of the utility fluid a barrier aligned transverse to the flow direction is provided in front of the lower end of the register in the direction of gravity, in order to protect the tubes against abrasion caused by interfering components entrained by the utility fluid. The interfering components are in this connection in particular particles, such as dust or the like.

The barrier is in this connection preferably installed where local peaks in the concentration of interfering components occur. On account of the influence of gravity on the interfering components this location is generally on the floor of the heat exchanger. The barrier is therefore preferably provided at the lower end of the register in the direction of gravity.

In this connection it may be envisaged that the barrier forms a gap with the floor of the heat exchanger. The utility fluid flows with increased velocity through this gap and can thus entrain interfering components collecting at the bottom and/or that have preferably sunk towards the bottom in the quiet zones, and in this way remove them from the heat exchanger. This in the end leads to a removal with the utility fluid. This is different however from the known removal in that the removal does not take place with the core flow of the utility fluid, but with an edge flow of the utility fluid close to the bottom. In this way the interfering components can be transferred without any problem directly to the sump of a downstream-connected plant unit, such as for example a washer.

It is convenient in this connection if the height of the free gap corresponds at most to about the minimum interspacing between the end of the register and the floor of the heat exchanger, so that the lower end of the register is not subjected to increased abrasion by the interfering components.

On account of the reduced structural effort involved in installing the register in the heat exchanger and replacing the register, the register is preferably designed as a suspended U-shaped tubular heat exchanger register with tube bends at the lower end of the register in the direction of gravity.

It may then also be envisaged that in the region of the tube bends in at least one tube row the channel width is a maximum at least in a flow channel with a large channel width. In other words, this at least one flow channel widens out downwardly in order to improve the removal of interfering components from the register, even if this has the result that the channel width of adjacent flow channels becomes correspondingly smaller, so that the width of the register overall can remain constant.

For the aforementioned reasons it may be advantageous if individual flow channels in the region of the tube bends have such a large channel width that as a result in at least one tube row the channel width is essentially zero at least in a flow channel with a small channel width. The corresponding adjacent tubes of the at least one tube row can in this case lie preferably almost abutting one another.

The afore-described structural features of the register of the heat exchanger can in principle be combined with one another in any arbitrary way. This applies in particular also to the various described ways in which a register of a heat exchanger can differ from a symmetrical construction. Use may therefore be made of different types of an asymmetric design and/or different dimensions of a specific asymmetric design for example in various tube rows and/or tube layers of different types. Use could also be made of such different designs in one and the same tube row and/or tube layer. In order to keep the complexity low as regards the production and design of the register, it is nevertheless convenient if in each case in one tube row and/or one tube layer use is made in each case of only one design, which overall leads to an asymmetric structure of the register. In other words, different tube layers and/or tube rows may then differ structurally from one another.

The afore-described register is on account of its design particularly suitable for heating and/or cooling a gas, such as in particular a flue gas, containing interfering components. In this connection the interfering components may be particles, condensate and/or entrained liquid. The effects of the register are accordingly manifested in particular if the register is connected upstream and/or downstream of a flue gas scrubber. The flue gas is then heated and/or cooled.

The invention is described in more detail hereinafter with the aid of a drawing simply illustrating exemplary embodiments, in which:

DETAILED DESCRIPTION OF THE INVENTION

Figure 1A:
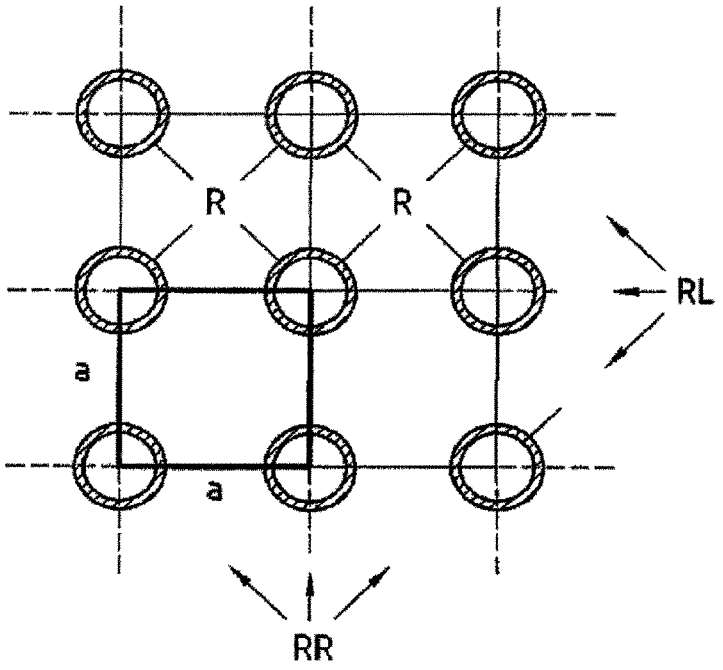
Fig. 1a PRIOR ART
FIG. 1*a* shows a register of a tube bundle heat exchanger of the prior art with a square distribution, in a sectional view perpendicular to the tubes of the tube bundle.
Figure 1B:
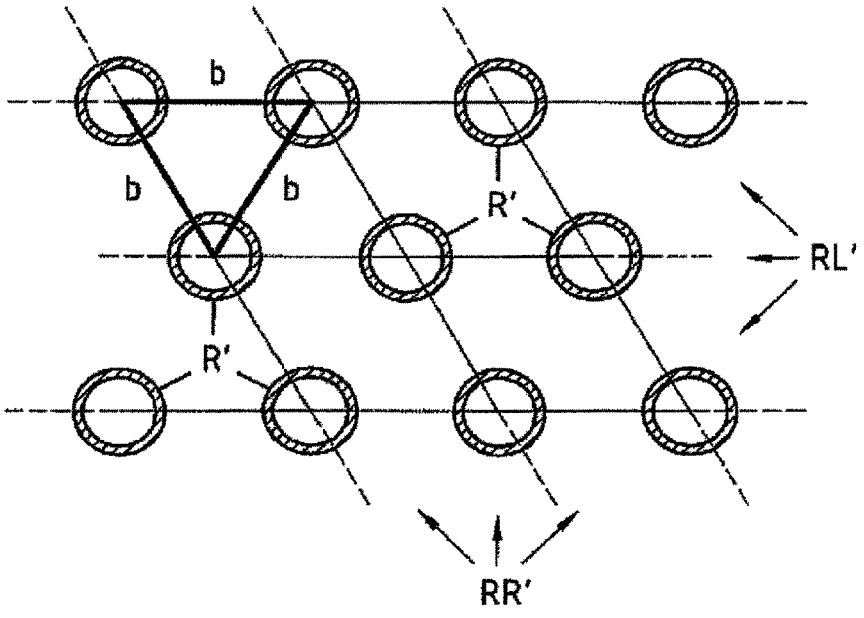
Fig. 1b PRIOR ART
FIG. 1*b* shows a register of a tube bundle heat exchanger of the prior art with a triangular distribution in a sectional view perpendicular to the tubes of the tube bundle.

Conventional types of a register that are known from the prior art are illustrated in FIGS. 1*a* and 1*b*. The tube bundle of a register of a heat exchanger illustrated in FIG. 1*a* has a square distribution. The tube mid-points of two adjacent tubes R of a tube row RR and of two tubes arranged flush therewith then form the corners of a square. In other words, in such a register the adjacent tubes R of a tube row RR as well as adjacent tubes R of a tube layer RL are in each case arranged at the same distance from one another. If this distance between the tube layers and the tube rows were different, this would not be a square distribution but a rectangular distribution. In this case too the distances between the tube rows and the tube layers of the register would be identical at every point of the register. Also the register then has a symmetrical structure.

In a tube bundle of a register of a heat exchanger with a triangular distribution, which is illustrated in FIG. 1*b*, the tube layers RL' are not aligned flush with one another, but are displaced with respect to one another by in each case half a tube interspacing. At every point within the register there are adjacently located three tubes R', whose mid-points lie at the vertices of a triangle and whose side edges have the same length b. This is therefore an equilateral distribution. The sides of a corresponding triangle defining the distribution could however also be of different lengths. In this case too all tube mid-points of corresponding adjacent tubes would however in each case define equal triangles. This means that registers constructed in this way are also symmetrical throughout.

The tubes R, R' in both a triangular distribution and in a square distribution form flow channels with a constant width. The displacement of the tube layers RL' with respect to one another means however that the tubes R' in a triangular distribution can be more tightly packed than the tubes R in a square distribution, without the pressure loss rising unduly. In the end an extremely symmetrical arrangement of the tubes R, R' within the register of a heat exchanger is obtained both in a square distribution as well as in a triangular distribution. This means that the distribution, i.e. the tube interspacings a, b, in each section of the register of a heat exchanger are identical. Consequently there exist neither flow channels of different channel width nor flow channels that have a wide section and a narrow section.

Figure 2:
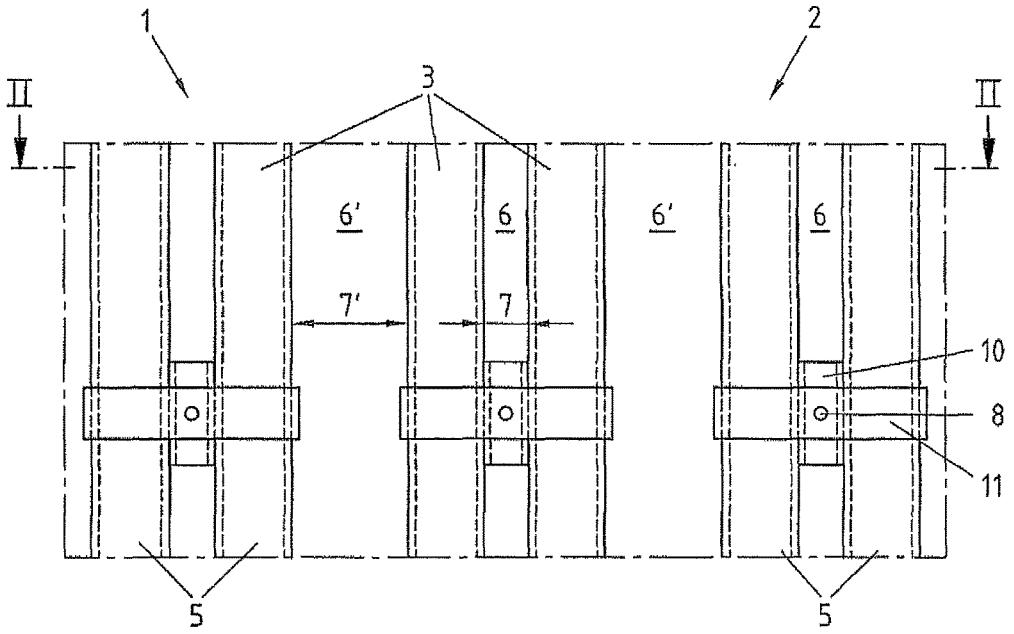
FIG. 2 shows a detail of a first embodiment of a register according to the invention in a direction parallel to the flow direction of the utility fluid.

FIG. 2 shows a detail of a heat exchanger 1 that comprises a register 2 with tubes 3 aligned parallel to one another. As is illustrated for example in FIG. 3 in a horizontal section along the plane II-II of FIG. 2, the register 2 has perpendicular to the flow direction S of the utility fluid a row of tube rows 4 arranged behind one another, which in the flow direction S of the utility fluid form tube layers 5 arranged parallel to one another. The individual tubes 3 of each tube layer 5 are arranged flush behind one another in the flow direction S of the utility fluid.

In the illustrated register 2 in each case two adjacent tube layers 5 define between them a flow channel 6, 6' for the flow through of the utility fluid. In this connection each flow channel 6, 6' in each tube row 4 has a channel width 7, 7' that is fixed by the interspacing of in each case adjacent tubes 3. In the case of the register 2 illustrated in FIGS. 2 and 3 the channel widths 7, 7' of each flow channel 6, 6' are constant in the flow direction S of the utility fluid. The channel width 7, 7' of the flow channels 6, 6' therefore does not change from tube row 4 to tube row 4 of the register 2. In addition the channel width 7, 7' in the illustrated embodiment is in each case aligned perpendicular to the flow direction S of the utility fluid.

In each tube row 4 of the illustrated register 2 flow channels 6, 6' with a large channel width 7' and a small channel width 7 alternate. On account of the larger channel width 7' a higher flow velocity of the utility fluid is established in the corresponding flow channels 6', while on account of the smaller channel width 7 a lower flow velocity of the utility fluid is established in the remaining flow channels 6.

Figure 3:
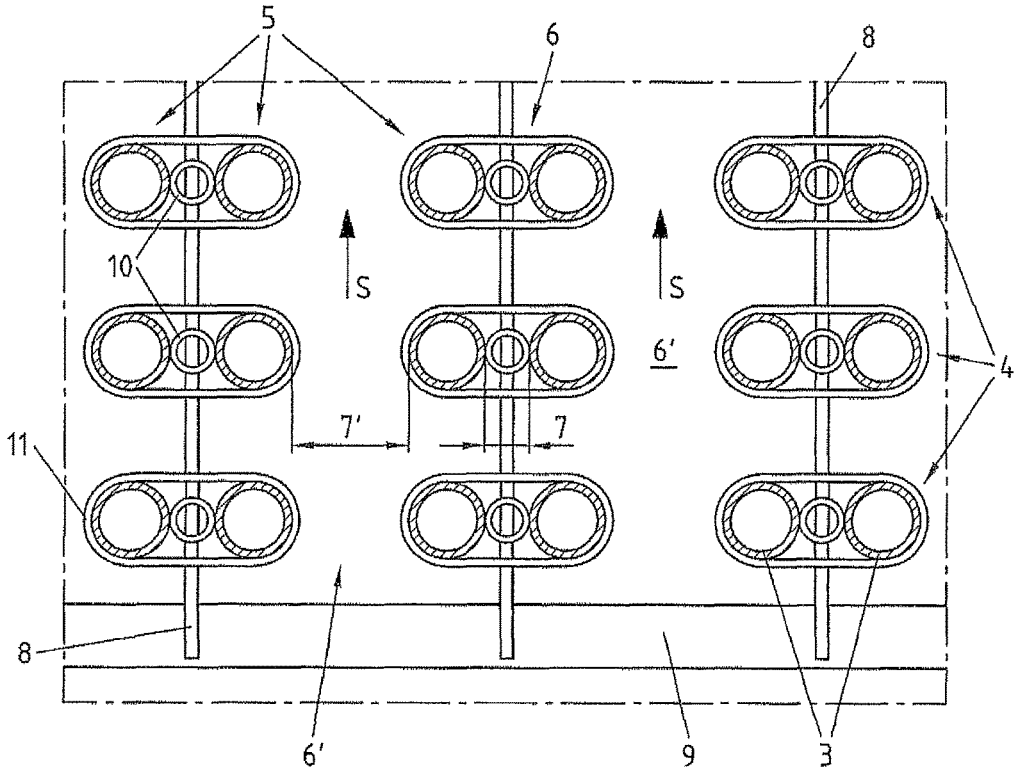
FIG. 3 shows the detail of the register of FIG. 2 in a sectional view along the plane II-II of FIG. 2.

The tubes 3 provided in the tube rows 4 illustrated in FIGS. 2 and 3 are in each case grouped in pairs and are fixed on a common rod-shaped retaining element 8 that extends parallel to the adjoining tube layers 5, i.e. in other words along the flow channel 6 of small channel width 7. In front of the register 2 the retaining elements 8 are held in the illustrated plane of the register 2 on a suspension 9 running transverse to the register. The retaining elements 8 have spacers 10, against which abut from two sides two adjacent tubes 3 of different tube layers 5. An annular element 11 surrounding the tubes 3 serves to fix in each case two adjacent tubes 3 of different tube layers 5 to a retaining element 8. Through the grouping in each case of two tube layers 5 to a retaining elements 8, the retaining elements in the illustrated register 2 are in each case provided only in every second flow channel 6.

Figure 4:
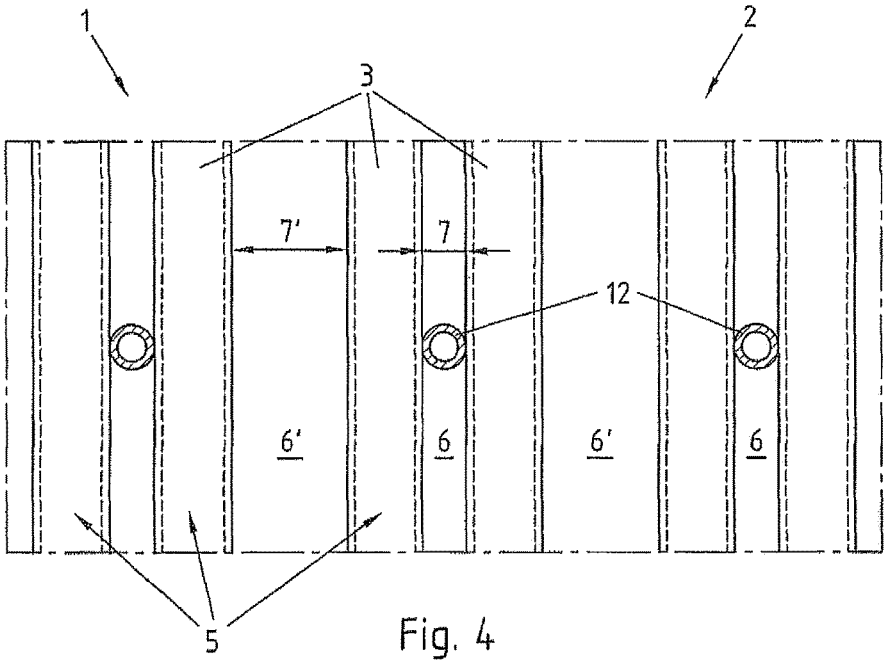
FIG. 4 shows a further detail of the register of FIG. 2 in a direction parallel to the flow direction of the utility fluid.

A further detail of the register 2 according to FIGS. 2 and 3 is illustrated in FIG. 4, wherein FIG. 4 illustrates a view corresponding to FIG. 2, which however shows a section in a region in which rinse lines 12 are provided for flushing and in this way removing interfering components from the register 2. For this purpose the rinse lines 12 can be arranged at different heights in the register. In any case, at least some of the rinse lines 12 are arranged relatively high in the register 2. In addition the rinse lines 12 are provided only in every second flow channel 6. In this connection the rinse lines 12 extend substantially along the whole flow channels 6 through the register 2. Furthermore it is possible, although not shown in detail, for the rinse lines 12 to be fixed to retaining elements 8.

In the illustrated register 2 the rinse lines 12 are provided in the narrow flow channels 6 and also have an external diameter that is substantially the same as the smaller channel width 7 of these flow channels 6. In this way the rinse lines 12, which abut against the adjacent tubes 3, serve at the same time as spacers 12 for in each case two adjacent tube layers 5. The rinse lines 12 have openings, not illustrated in more detail, over their length, from which a rinse medium, such as for example water, can flow as necessary. With the rinse medium adhering interfering components in the form of solids particles for example can be removed, these being discharged from the register 2 together with the rinse medium, for the most part in the direction of gravity, whereby long service lives can be achieved.

As a comparison of FIGS. 2 and 4 shows, the channel width 7, 7' of the respective flow channel 6, 6' does not vary as regards its height in the illustrated register 2, but remains constant. This is achieved in particular if the tubes 3 run parallel to one another.

Figure 5:
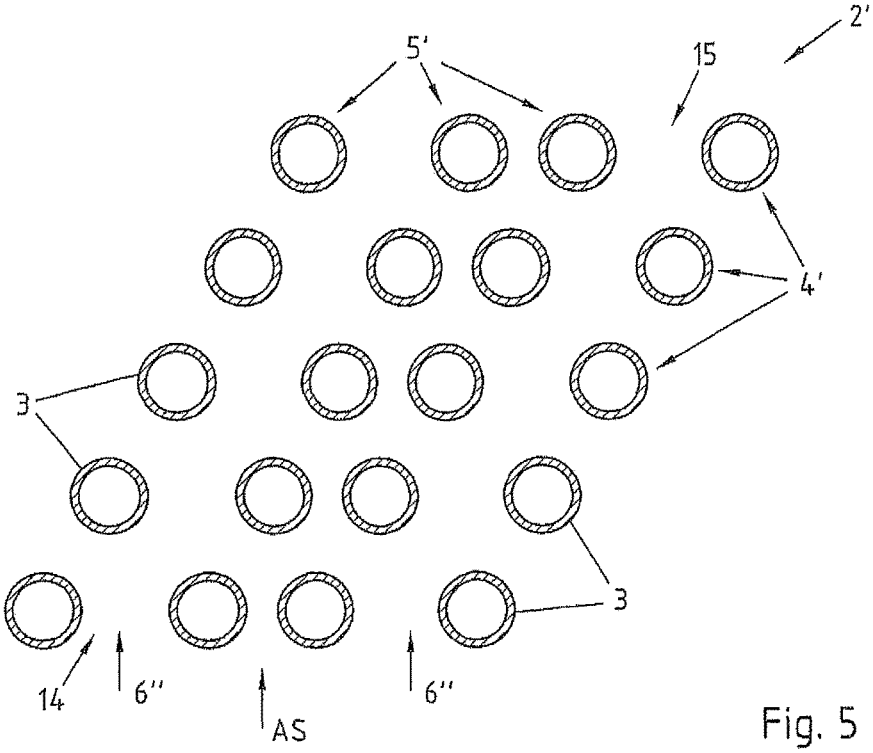
FIG. 5 shows a detail of a second embodiment of the register according to the invention in a sectional representation according to FIG. 3.

FIG. 5 shows a register 2' schematically in a section perpendicular to the longitudinal length of the tubes 3. In this register the tube layers 5' are not parallel, but are aligned slanted to the inflow direction AS of the utility fluid in relation to the register 2'. This is achieved by a slight misalignment of the tube rows 4' following one another in the inflow direction AS by a fraction in any case of the channel width of the flow channel 6" of large channel width. In this way flow channels 6" are formed, in which the inlet-side openings 14 of the flow channels 6" for the utility fluid no longer overlap with the outlet-side openings 15 of the flow channels 6".

Figure 6:
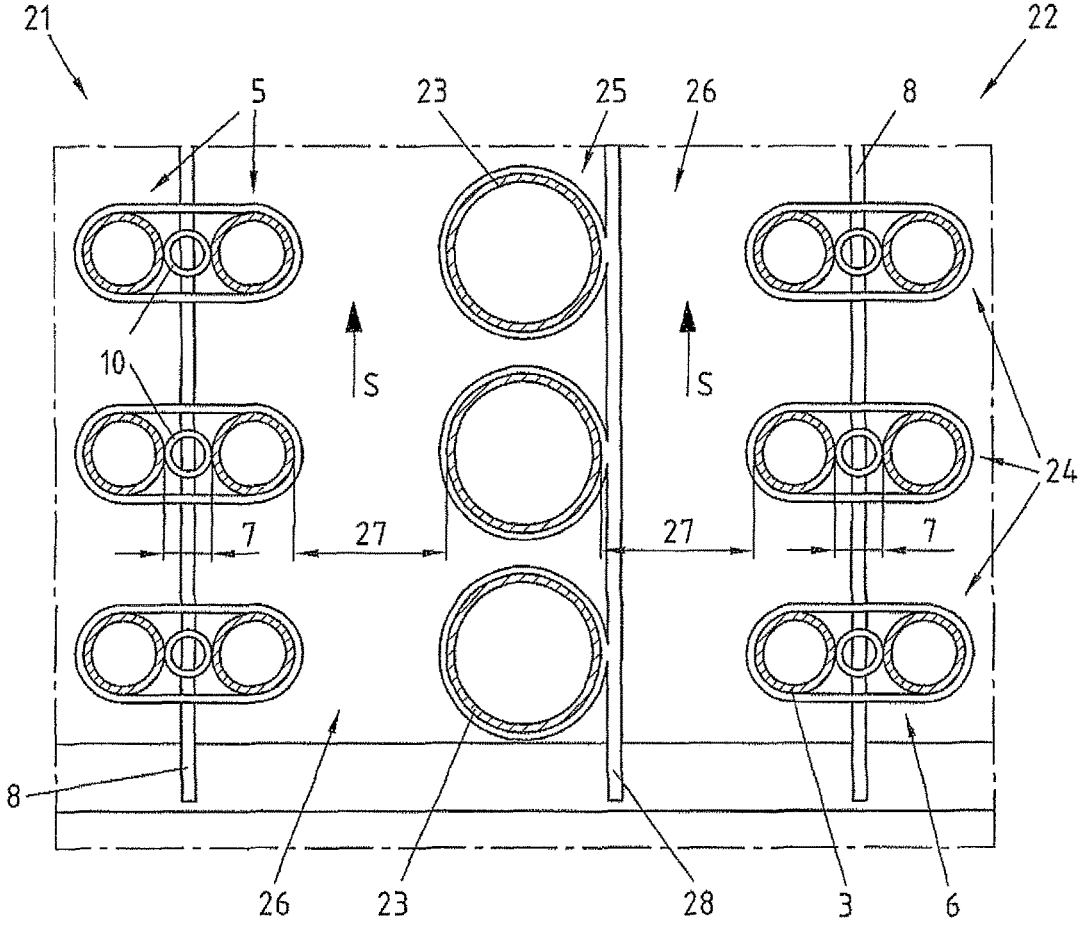
FIG. 6 shows a detail of a third embodiment of the register according to the invention in a sectional representation according to FIG. 3.

The register 22 of a heat exchanger 21 illustrated in FIG. 6 differs from the register 2 illustrated in FIGS. 2 and 3 in that tubes 3, 23 of different diameters are installed. In this connection exclusively tubes 3, 23 of identical diameter are provided in each tube layer 5, 25. The tube layers 5, 25 are also assembled together to form the register 22 in such a way that two tube layers 5 with tubes 3 of small diameter are always followed by a tube layer 25 of a large diameter and this in turn is always followed by two tube layers 5 with tubes 3 of small diameter. The two adjacent tube layers 5 with tubes 3 of smaller diameter are in this case held by a common retaining element 8, which extends along the flow channel 6 formed by these two tube layers 5 and is likewise rod-shaped. This flow channel 6 is in each case a flow channel with a constant small channel width 7. On the other hand between the tube layer 25 with the tubes 23 with a large diameter and the adjoining tube layer 5 with tubes 3 with a small diameter, there is always a flow channel 26 that has a large channel width 27.

For economic reasons each tube layer 25 with tubes 23 with a large diameter is held by a separate retaining element 28, which is arranged to the side of the tube layer 25. This retaining element 28 can therefore also function without separate spacers. The two in each case adjacent tube layers 5 with tubes 3 of a smaller diameter are in the illustrated embodiment constructed as already described with reference to FIGS. 2 to 4. The same also applies in principle to the arrangement of the rinse line in the flow channels 6 with a small channel width 7, in other words the flow channels 6 between the tube layers 5 with tubes 3 of a small diameter. The register 22 illustrated in FIG. 6 comprises exclusively rectilinearly formed tubes 3, 23. However in any case tubes that are to some extent curved could also be used to construct the register.

Figure 7:
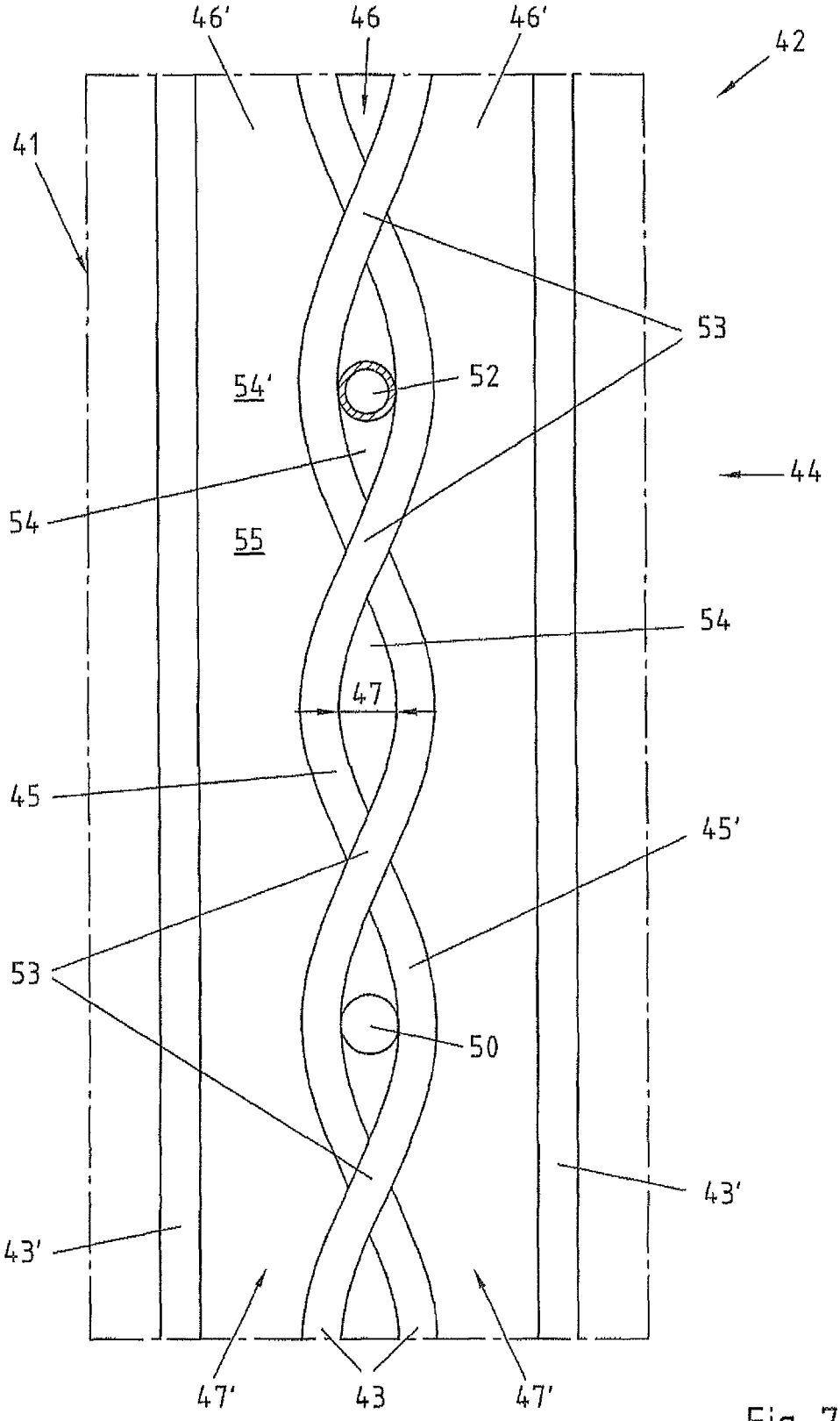
FIG. 7 shows a detail of a fourth embodiment of the register according to the invention in a viewing parallel to the flow direction of the utility fluid.

In the register 42 of a heat exchanger 41 illustrated in FIG. 7, similar to the register 2 illustrated in FIG. 2, simply the front-most tube row 44 is illustrated since the further tube rows 44 are arranged flush with the front tube row 44.

The special feature of the register 42 illustrated in FIG. 7 compared to the register 2 according to FIGS. 2 to 4 is that the tubes 43 are alternately part of a first tube layer 45 and a second tube layer 45' of the common tube row 44. The tubes cross one another at the transition from the first tube layer 45 to the second tube layer 45', and vice versa. A flow channel 46 with narrow sections 54, i.e. smaller channel widths 47, is formed between the corresponding crossing points 53. Individual members of the narrow sections 54 have a spacer 50 or a flush line 52. In the illustrated embodiment the flush line 52 has the same external diameter as the spacer 50, so that the flush line 52 holds the two paired crossed tubes 43 simultaneously at the desired interspacing from one another.

The illustrated tubes 43 crossed with one another are rigidly designed, so that means does not have to be provided in each case between two crossover points 53 of the tubes 43 that contributes to the interspacing of the tubes 43. When using flexible tubes such means would preferably be provided between in each case two adjacent crossing points of a flow channel so that the tubes can permanently adopt the desired positions.

The flow channels 46' adjoining the two paired crossed tubes 43 have varying channel widths 47'. The flow channels 46' are broadest at the height of the crossing points 53 and narrowest at the mid-height between the crossing points 53. In this way the flow channels 46' adjoining the crossed tubes 43, which channels are bounded by the adjacent rectilinearly running tubes 43' of the tube row 44, in turn have narrow sections 54' and wide sections 55 alternating over their height.

The crossing of the tubes 43 is accomplished in the embodiment illustrated in FIG. 7 in the manner of a wickerwork, in which each of the two tubes 43 crossed with one another is led alternately in the flow direction S in front of and behind the respective other tube 43 to the in each case other tube layer 45, 45'.

Figure 8:
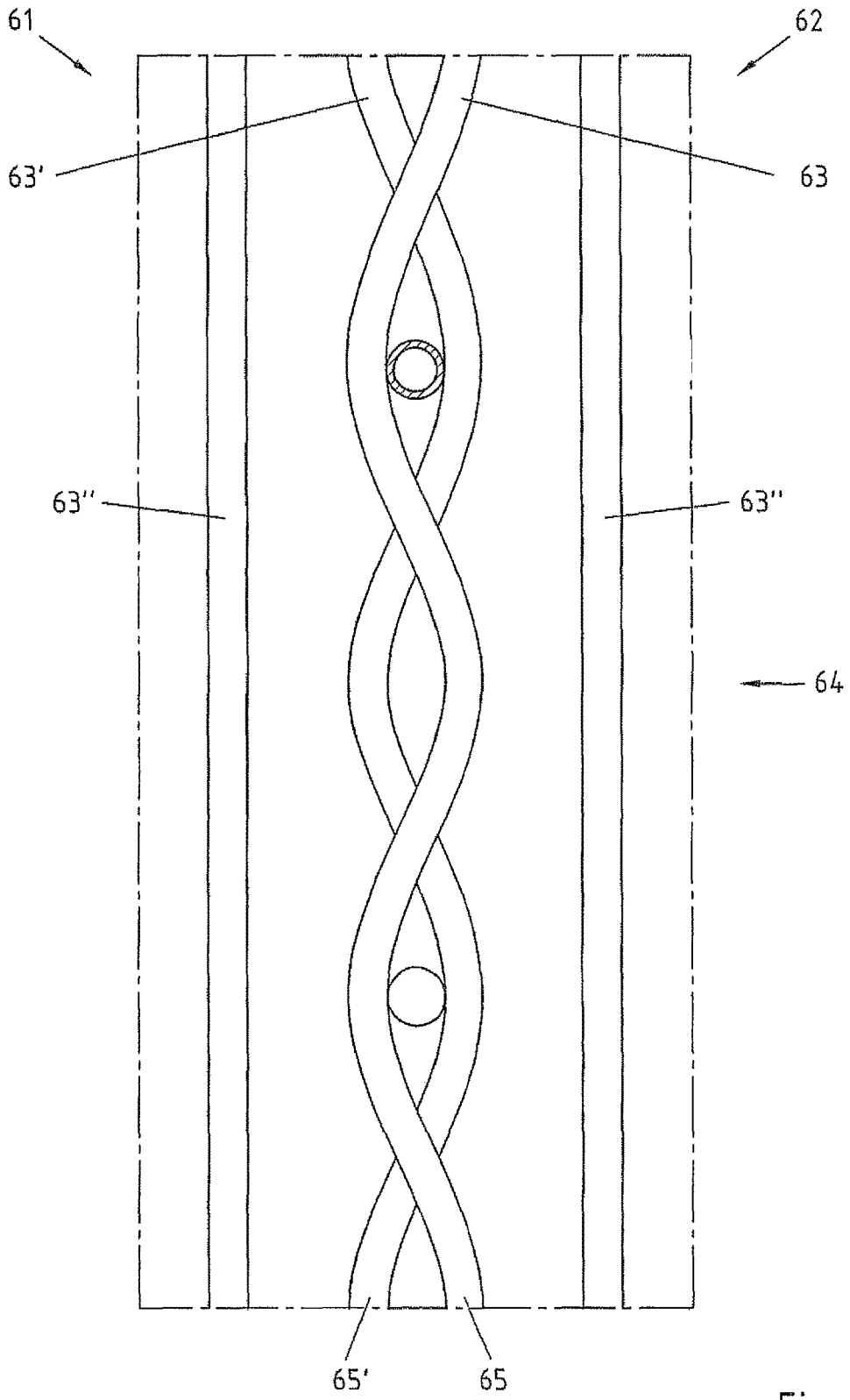
FIG. 8 shows a detail of a fifth embodiment of the register according to the invention in a viewing parallel to the flow direction of the utility fluid.

However, as in the embodiment of a register 62 of a heat exchanger 61 illustrated in FIG. 8, this arrangement can if necessary be dispensed with. Instead, the one tube 63 of the two tubes 63, 63' crossed with one another is always led in front of the other tube 63' to the other tube layer 65, 65'.

With the registers 42, 62 illustrated in FIGS. 7 and 8 tubes 43, 63, 63' crossed paired with one another and rectilinearly running tubes 43', 63" in a tube row 44, 64, alternate with one another.

Figure 9:
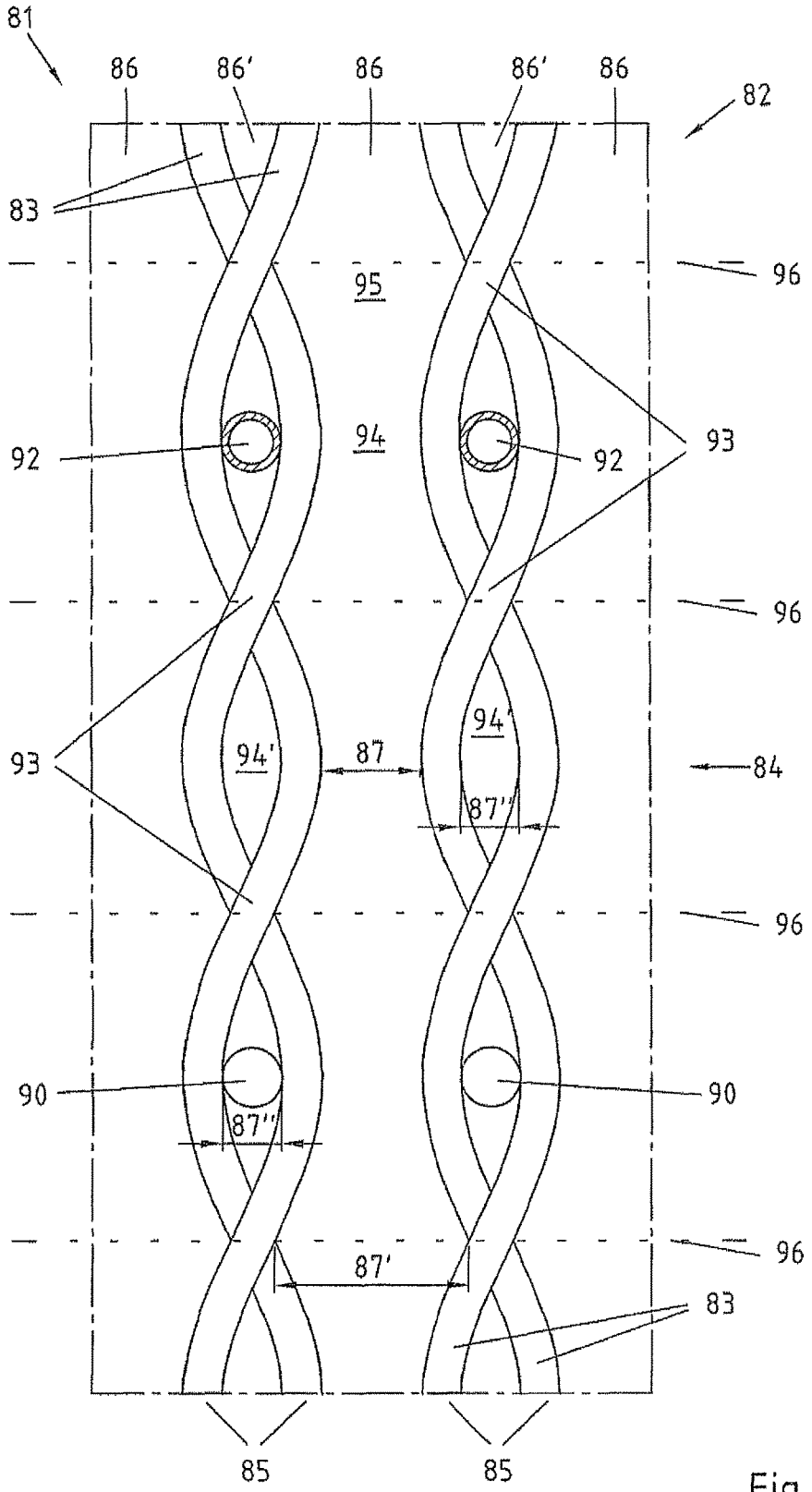
FIG. 9 shows a detail of a sixth embodiment of the register according to the invention in a viewing direction parallel to the flow direction of the fluid.

However, with the register 82 of a heat exchanger 81 illustrated in FIG. 9, all tubes 83 of a tube row 84 are in each crossed paired with one another, and more specifically in each case multiply over the longitudinal length of the tubes 83. In this case always the same tubes 83 are crossed with one another. In principle however tubes alternating with different tubes, preferably of different tube layers, could also be crossed with one another. Likewise, it is not essential that simply tubes 83 of adjacent tube layers 85 are crossed with one another and/or that the tubes 83 crossed one another always belong to the same tube row 84. The tubes 83 are crossed with one another in a wickerwork arrangement.

The register 82 illustrated in FIG. 9 has exclusively paired crossed tubes 83. The crossing points 93 of the in each case paired crossed tubes 83 in any case of one tube row 84 lie in common planes 96 parallel to the flow direction. In this way wide sections 95 and narrow sections 94 therebetween are provided in the flow channels 86 between the paired crossed tubes 83 in the region of the crossing points 93, so that the channel widths 87, 87' vary over the longitudinal length of the flow channels 86. The paired crossed tubes 83 define between them in each case a flow channel 86', which has exclusively narrow sections 94' with smaller channel widths 87", though these do not have to be identical to the narrow sections 94' of the in each case adjacent flow channels 86.

With regard to the spacers 90 and rinse lines 92 provided if necessary in the flow channels 86' defined by the paired crossed tubes 83, the same is true as has already been said concerning the heat exchanger 41 illustrated in FIG. 7.

In a non-illustrated embodiment of a register with in each case paired crossed tubes, the crossing points of adjacent tubes in each case crossed with one another could also lie on different planes. For example, only every second crossing point in the direction of a tube row lies in one of these planes. Preferably in each case the crossing points of two tubes crossed with one another looking in the longitudinal direction of the tubes and/or of the register lies substantially, in particular centrally, between the crossing points of the adjacent tubes crossed with one another, in particular on both sides of the tube row. The crossing points of these adjacent in each case paired crossed tubes on both sides of the tube row then preferably lie on common planes, in particular also with the crossing points of the in each case next but one paired crossed tubes of the at least one tube row.

A corresponding arrangement has the result that the flow channel between in each case two paired crossed tubes has a relatively uniform channel width over the flow channel height. According to a corresponding embodiment the corresponding flow channel would assume a substantially sinuous shape.

Figure 10:
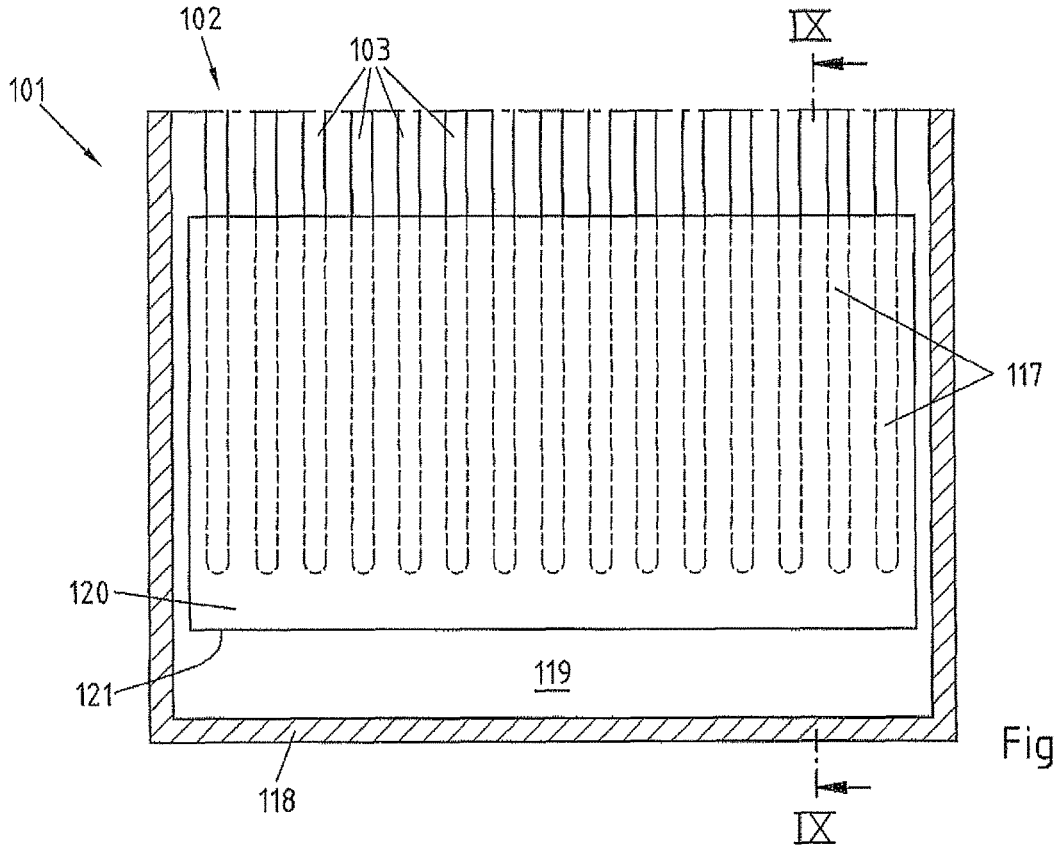
FIG. 10 shows the floor region of a first embodiment of the heat exchanger according to the invention in a viewing direction parallel to the flow direction of the utility fluid.
Figure 11:
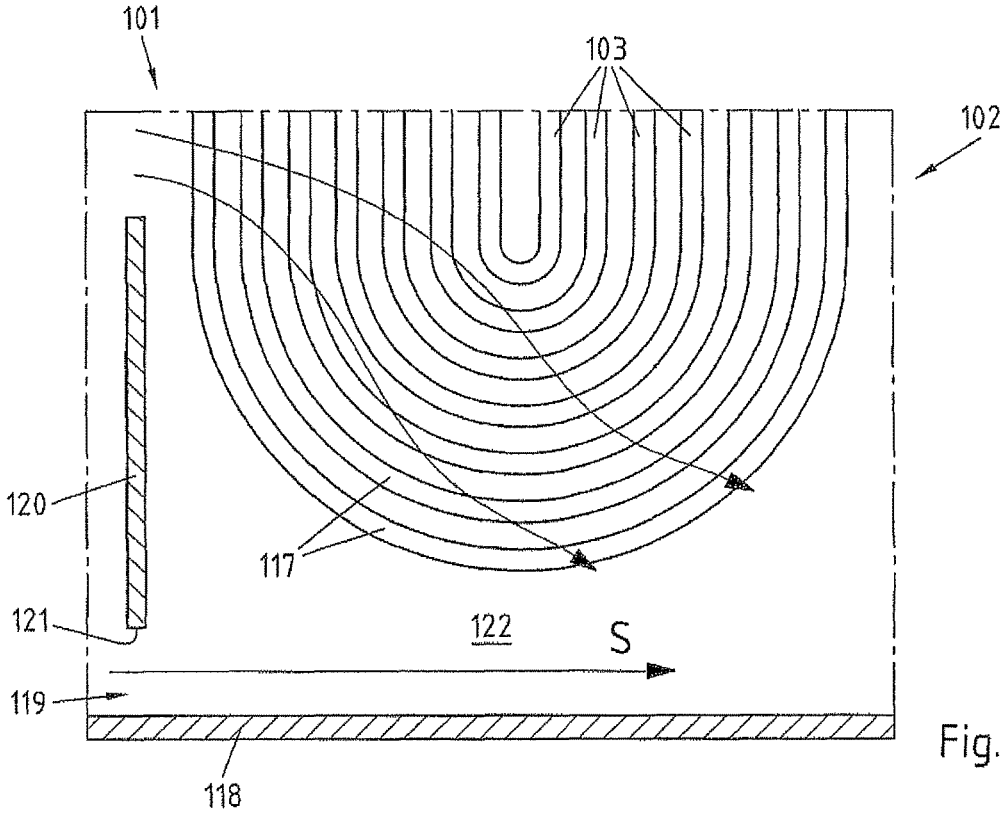
FIG. 11 shows the floor region of the heat exchanger of FIG. 10 in a sectional representation along the plane IX-IX of FIG. 10.

The floor region of heat exchanger 101 with U-shaped tubes 103 is illustrated in FIG. 10. The U-shaped tubes 103 of the register 102 are suspended in the heat exchanger 101 in the direction of gravity, so that the tube curvatures 117 of the U-shaped tubes 103 point in the direction of the floor 118 of the heat exchanger 101. A gap 119, through which the utility fluid can flow, remains between the bent tubes 103 and the floor 118 of the heat exchanger 101. In the region of the tube curvatures 117 there is installed in the flow direction S of the utility fluid in front of the tubes 103 of the register 102 an in this case plate-shaped barrier 120, which in the illustrated embodiment extends in a plane perpendicular to the flow direction S of the utility fluid. In this connection the barrier 120 is arranged so that a gap 119 is formed between the floor 118 of the heat exchanger 101 and the lower edge 121 of the barrier 120, through which the utility fluid flows with increased velocity and in the floor region entrains deposited interfering components, such as for example particles, without at the same time causing an increased abrasion of the register 102 in the region of the tube curvatures 117. This increased flow velocity of the utility fluid in the gas 122 underneath the tube curvatures 117 is illustrated diagrammatically in the sectional view of FIG. 11.

As a result of the build-up of the utility fluid in the flow direction S in front of the barrier 120, increased flow velocities are likewise produced when the utility fluid overflows the barrier 120, so that the utility fluid flows with increased flow velocity through the region of the tube curvatures 117 and there removes interfering components that have sunk down from above from the flow of the utility fluid. In addition the flow channels with large channel widths can be widened in the region of the lower end of the register, where the tube curvatures are located, as a result of which the flow channels with small channel widths become locally narrower. This can have a positive effect in transporting the interfering components away from the register.

The invention claimed is:

1. A register for indirect heat exchange between a utility fluid containing interfering components and a heat transfer fluid in a heat exchanger, the register comprising:

a plurality of tubes for the passage of the heat transfer fluid, the tubes extending in a vertical direction from a top of the heat exchanger to a bottom of the heat exchanger, wherein the tubes are arranged in a plurality of tube layers; and a plurality of tube rows, wherein the tube layers and the tube rows run transversely to one another, wherein the tube layers define a plurality of flow channels for the utility fluid to flow through, wherein in at least one tube row there is provided a plurality of flow channels having alternately narrow widths and wide widths such that every second flow channel has a first channel width defined by the minimum distance between adjacent tubes of the tube row and every other second flow channel has a second channel width defined by the minimum distance between adjacent tubes of the tube row, the second channel width being larger than the first channel width and retaining elements in the shape of a rod and extending substantially along the tube layers are provided only in the flow channels having the first channel width such that the tubes of the at least one tube row adjacent to the respective retaining element are fixed to the respective retaining element, or wherein in at least one tube row there is provided at least one flow channel having a first section having a channel width defined by the minimum distance between the adjacent tubes of the tube row in the first section and extending in the longitudinal direction of the tubes and having a second section having a channel width defined by the minimum distance between the adjacent tubes of the tube row in the second section and extending in the longitudinal direction of the tubes, the channel width of the second section being larger than the channel width of the first section and in the at least one tube row, retaining elements in the shape of a rod and extending substantially along the tube layers are provided only in every second flow channel such that the tubes of the at least one tube row adjacent to the respective retaining element are fixed to the respective retaining element.

2. The register according to claim 1, wherein a constant channel width is provided in at least two tube rows following one another in the flow direction of the utility fluid in at least one flow channel.

3. The register according to claim 1, wherein exactly one tube layer is fixed on at least one retaining element of the register and exactly two adjacent tube layers are fixed on at least one other retaining element.

4. The register according to claim 1, wherein the retaining elements run substantially laterally to the tube layers held by the retaining element.

5. The register according to claim 1, wherein the retaining elements between the tubes of at least one tube row located on the retaining elements have spacers for spacing the tubes located on the retaining elements and/or are formed as spacers.

6. The register according to claim 1, wherein the retaining elements are arranged in the flow channel with the first channel width and/or in the first section of the flow channel.

7. The register according to claim 1, wherein a rinse line for the supply of rinse medium is provided in at least one flow channel with the first channel width or in the first section in at least one tube row.

8. The register according to claim 7, wherein a rinse line is provided in every second flow channel in at least one tube row.

9. The register according to claim 7, wherein the rinse lines are adapted as spacers for spacing adjacent tubes of the at least one tube row.

10. The register according to claim 7, wherein the rinse lines are arranged in the flow channel with the first channel width and/or in the first section of the flow channel.

11. The register according to claim 7, wherein at least one retaining element is simultaneously formed as a rinse line, or vice versa.

12. The register according to claim 1, wherein at least one tube layer is aligned at least in sections inclined and/or curved in relation to the inflow direction of the utility fluid through the register.

13. The register according to claim 12, wherein at least two tube layers define between them a flow channel with an opening on the inlet side and an opening on the outlet side for the utility fluid in such a way that the opening on the inlet side in the inflow direction of the utility fluid in relation to the register does not overlap the opening on the outlet side.

14. The register according to claim 1, wherein in at least one tube row there is arranged at least one flow channel with alternately narrow sections and wide sections in the longitudinal direction of the tubes.

15. The register according to claim 14, wherein in at least one tube row all flow channels have alternately narrow sections and wide sections.

16. The register according to claim 14, wherein in at least one tube row flow channels are arranged next to one another at least in sections so that wide sections and narrow sections and/or second channel widths and first channel widths alternate.

17. The register according to claim 1, wherein in at least two tube rows following one another in the flow direction of the utility fluid there are provided in at least one flow channel alternately a narrow section and a wide section or alternately the second channel width and the first channel width.

18. The register according to claim 1, wherein at least individual tubes of at least one tube row are arranged in regions in a first tube layer and in regions in a second tube layer.

19. The register according to claim 18, wherein the first tube layer and the second tube layer are adjacent layers.

20. The register according to claim 18, wherein at least some of the individual tubes of at least one tube row cross one another, at least once, along the longitudinal length of the tubes.

21. The register according to claim 20, wherein substantially all tubes of at least one tube row are crossed, at least once, along the longitudinal length of the respective tubes with an adjacent tube.

22. The register according to claim 21, wherein in at least one tube row the crossing points of the tubes are arranged substantially on the same plane perpendicular to the longitudinal length of the tubes.

23. The register according to claim 21, wherein in at least one tube row adjacent tubes that do not cross one another have crossing points on different planes perpendicular to the longitudinal length of the tubes.

24. The register according to claim 23, wherein in at least one tube row adjacent tubes crossing one another define via their crossing points planes perpendicular to the longitudinal length of the tubes, which are arranged, substantially centrally, between the planes running perpendicular to the longitudinal length of the tubes, which are defined by the crossing points of further, substantially adjacent, tubes crossing one another.

25. The register according to claim 19, wherein in at least one tube row there are provided tubes formed substantially rectilinearly adjacent to tubes crossing one another.

26. The register according to claim 1, wherein in at least one tube row and/or tube layer there are provided tubes with significantly different tube diameters.

27. The register according to claim 26, wherein in at least one tube layer there are provided tubes with an identical tube diameter.

28. The register according to claim 1, wherein the tubes of the register are made of metal and/or a plastic material.

29. The register according to claim 1, wherein the tubes are formed as rigid or flexible tubes.

30. The register according to claim 1, wherein at least one tube row and/or one tube layer comprise flexible tubes as well as rigid tubes.

31. The register according to claim 1, wherein at least one tube layer is formed as a tube disc to reflect sound waves.

32. The register according to claim 31, wherein two to six tube discs are provided in the register.

33. A heat exchanger with at least one register, wherein the register is a register according to claim 1.

34. The heat exchanger according to claim 33, wherein in the flow direction of the utility fluid there is provided in front of the lower end of the register in the direction of gravity a barrier aligned transverse to the flow direction to protect the register against abrasion by particles entrained by the utility fluid.

35. The heat exchanger according to claim 33, wherein the barrier forms together with a floor of the heat exchanger a gap provided for the accelerated throughflow of the utility fluid.

36. The heat exchanger according to claim 35, wherein the height of the free gap corresponds at most to substantially the minimum interspacing between the lower end of the register and the floor of the heat exchanger.

37. The heat exchanger according to claim 33, wherein the tubes of the register have tube curvatures at the lower end of the register in the direction of gravity.

38. The heat exchanger according to claim 37, wherein in the region of the tube curvatures in at least one tube row the channel width is a maximum at least in a flow channel with the second channel width.

39. The heat exchanger according to claim 38, wherein in the region of the tube curvatures in at least one tube row the channel width is essentially zero at least in a flow channel with the first channel width.

40. A register according to claim 1, adapted for use with a heating and/or cooling gas containing interfering components.

41. The register according to claim 40, wherein the interfering components are particles or condensate.

42. The register according to claim 40, wherein the interfering component is entrained liquid.

43. The register according to claim 40, wherein a flue gas scrubber is connected upstream and/or downstream of the register.

44. The register according to claim 40, wherein the heating and/or cooling gas is flue gas.

* * * * *